US006065945A

United States Patent [19]

Zamzow

[11] Patent Number: 6,065,945

[45] Date of Patent: May 23, 2000

[54] HYDRAULIC ENGINE

[76] Inventor: Charles W. Zamzow, 333 37th Ave. NE., St. Petersburg, Fla. 33704

[21] Appl. No.: 09/033,902

[22] Filed: Mar. 3, 1998

[51] Int. Cl.[7] ..... F04B 35/02

[52] U.S. Cl. ..... 417/401

[58] Field of Search ..... 417/245, 390, 417/391, 400; 60/371, 419; 91/275, 325

[56] References Cited

U.S. PATENT DOCUMENTS

| | | | |
|---|---|---|---|
| 286,751 | 10/1883 | Webster | 417/345 |
| 338,378 | 3/1886 | Willans . | |
| 615,884 | 12/1898 | Ogle . | |
| 1,160,445 | 11/1915 | Patitz . | |
| 2,863,426 | 12/1958 | Summerlin | 60/595 |
| 2,932,257 | 4/1960 | Lupin | 417/16 |
| 3,374,746 | 3/1968 | Chenault | 103/46 |
| 3,700,360 | 10/1972 | Shaddock | 417/404 |
| 4,068,468 | 1/1978 | Wood et al. | 60/39.141 |
| 4,234,294 | 11/1980 | Jensen | 417/377 |
| 4,234,295 | 11/1980 | Jensen | 417/390 |
| 4,353,683 | 10/1982 | Clark | 417/379 |
| 4,446,773 | 5/1984 | Emonet | 91/317 |
| 5,484,269 | 1/1996 | Vick | 417/225 |
| 5,536,150 | 7/1996 | Tucker | 417/390 |
| 5,616,005 | 4/1997 | Whitehead | 417/46 |

*Primary Examiner*—Timothy S. Thorpe
*Assistant Examiner*—David J. Torrente
*Attorney, Agent, or Firm*—Dennis G. LaPointe; Mason & Assoc., P.A.

[57] ABSTRACT

A hydraulic engine employs dual cylinders and pistons of different diameter connected end-to-end in collinear alignment. Fluid from a pressurized source drives the large piston to transmit power to a crankshaft. An electromagnetic actuator, controlled by a distributor, opens a control valve, admitting fluid to the large cylinder. A hydraulic actuator closes the control valve, shutting off fluid flow. The hydraulic actuator responds to pressure drop when the large piston uncovers an exhaust port. Fluid drains to a tank, and the cycle repeats. The small piston recirculates fluid from the tank to the source.

17 Claims, 4 Drawing Sheets

HYDRAULIC ENGINE

FIELD OF THE INVENTION

The present invention relates generally to the field of hydraulic machinery, and pertains, more specifically, to a tandem piston and crank apparatus that converts the energy from a source of hydraulic fluid under pressure into the kinetic energy of a rotating shaft, and returns some of the fluid to the source.

BACKGROUND OF THE INVENTION

Industry often has requirements to operate rotating equipment from a source of hydraulic fluid under pressure. Examples of such equipment are pumps, compressors, generators, and heavy road building machines. These devices employ a gasoline, diesel, or electric motor as a source of power, connected to a pump to drive a hydraulic motor which in turn operates the machinery. The machinery can only be operated while the source motor/pump is running. When the source motor/pump is shut off or malfunctioning, the machinery is inoperable.

Hydraulic engines with built in pumps and having tandem pistons are known and, heretofore, have been configured in different ways. Some examples of piston engines with pumps in the prior art are seen in the following U.S. patents:

Jensen, U.S. Pat No. 4,234,295, shows a dual in-line piston device operating within a well. A continuously driven hydraulic pump conveys fluid from a large cylinder, through a valve set to a first position, into a high-pressure accumulator. In the second valve position, fluid flows from the accumulator to the pump to the large cylinder, forcing a large piston upward. A small piston connected in tandem then raises well liquid to the surface.

Jensen, U.S. Pat No. 4,234,294, shows another dual in-line piston device operating within a well. A continuously driven hydraulic pump conveys fluid from a tank, through a valve set to a first position, to a large piston, driving it downward while forcing well liquid upward to storage, and charging a high-pressure accumulator with fluid through a free-piston device. In the second valve position, fluid flows from the accumulator to the pump to the free-piston device, forcing well liquid into the large cylinder, forcing the large piston upward, which returns fluid to the tank. The small piston is used to draw well liquid in to recharge the large cylinder.

In each Jensen patent, the system functions only while the motor-driven pump is running. The accumulator is used for temporary fluid storage during half of each cycle to provide a boost during the other half cycle. The purpose of these inventions is not to produce power from a rotating shaft, but to raise liquid from a well.

Chenault, U.S. Pat. No. 3,374,746, discloses a subsurface triple in-line piston device for pumping well liquid. A surface motor driven pump acts upon a first drive piston. A second piston is used for recirculating fluid. A third piston pumps well liquid to the surface. Here again, the system functions only while the motor-driven pump is running. There is no accumulator or control valve.

Shaddock, U.S. Pat. No. 3,700,360, illustrates a dual in-line piston device. High pressure fluid from a vehicle engine-driven pump is directed through a control valve actuated by a pilot valve, alternately to both sides of a drive piston. A tandem pump piston forces water at high pressure through a hose and nozzle. The device is solely for pumping water. No output shaft or accumulator is provided.

Vick, U.S. Pat. No. 5,484,269, shows a fluid intensifier having tandem pistons, a control valve and a pilot valve. The device converts high fluid flow at low pressure to low flow at high pressure. There is no output shaft or accumulator.

Whitehead, U.S. Pat. No. 5,616,005, discloses a bi-directional dual piston pump driven by fluid to pump an external fluid. A pair of control valves regulate the drive portion. No output shaft or accumulator is disclosed.

While the above-described inventions serve to pump fluids satisfactorily, none are capable of producing rotary shaft power output. Furthermore, none are able to operate for extended periods of time on a source of stored energy.

Accordingly, there is a need to provide a hydraulic engine capable of producing rotary shaft output, and operating from a source of stored pressurized fluid for long periods of time without any external energy input. Such a device would be especially useful during periods of power blackout.

SUMMARY OF THE INVENTION

The present invention employs dual cylinders and pistons of different diameter connected end-to-end in collinear alignment. Fluid from a pressurized source drives the large piston to transmit power to a crankshaft. The small piston recirculates fluid to the source. A distributor and solenoid open a control valve to convey fluid to the large cylinder. Pressure drop as the large piston uncovers an exhaust port actuates the valve closed.

The above features, as well as further features and advantages, are attained by the present invention which may be described briefly as a hydraulic engine comprising: an upper cylinder extending between opposite first and second ends, the first end being closed and including an intake injector port, the upper cylinder having a predetermined inside diameter, having an exhaust port intermediate the first and second ends, having a sensing port intermediate the exhaust port and the first end; a lower cylinder extending between opposite first and second ends, the first end being connected to the upper cylinder second end, the lower cylinder second end being closed and including an inlet port and an outlet port, the lower cylinder having an inside diameter less than the upper cylinder inside diameter; an upper piston mounted within the upper cylinder for sealed sliding movement therein, the upper piston having a topmost position adjacent the first end; a lower piston mounted within the lower cylinder for sealed sliding movement therein; an upper piston rod connecting the upper piston with the lower piston; a lower piston rod projecting from the lower piston and mounted for sealed sliding movement penetrating the lower cylinder second end; converting means, connected to the lower piston rod, for converting reciprocating motion to rotary motion; a source of pressurized fluid; a tank for storing fluid at ambient pressure; exhaust communicating means for communicating fluid from the exhaust port to the tank; a control valve having an open position wherein the pressurized fluid source communicates with the intake injector port, and a closed position wherein the intake port is sealed; first actuating means, responsive to the position of the upper piston, for actuating the control valve into the open position when the upper piston is in the generally topmost position, so that pressurized fluid will pass through the intake injector port and enter the upper cylinder, the upper piston will move downward in response to the pressurized fluid pressure, and the upper piston will pass the exhaust port allowing the fluid pressure to decrease to ambient pressure; second actuating means, responsive to the decrease in upper cylinder fluid pressure, for actuating the control valve into the closed position when the upper piston passes the exhaust port, so that pressurized fluid will cease to flow through the intake injector port, and fluid will flow out the exhaust port, through the exhaust communicating means, and into the tank; inlet communicating means for communicating fluid unidirectionally from the tank to the inlet port, so that as the lower piston moves upward, fluid will be drawn into the lower cylinder; and outlet communicating means for communicating fluid unidirectionally from the outlet port to the pressurized fluid source, so that as the lower piston moves downward, fluid will be pressurized, and will flow from the lower cylinder to the pressurized fluid source to generally replenish the pressurized fluid source.

The second actuating means is connected between the sensing port and the pressurized fluid source, and is responsive to a pressure differential therebetween.

The converting means includes a crankshaft; the angular position of the crankshaft correlates directly with the linear position of the upper piston; and the first actuating means is connected to the crankshaft, so as to respond to the position of the upper piston by sensing the correlating angular position of the crankshaft.

Flow regulating means is connected between the pressurized fluid source and the control valve, for regulating the flow rate of fluid into the upper cylinder, thereby regulating the speed of the engine.

BRIEF DESCRIPTION OF THE DRAWING

The invention will be more fully understood, while still further features and advantages will become apparent, in the following detailed description of preferred embodiments thereof illustrated in the accompanying drawing, in which.

DESCRIPTION OF THE PREFERRED EMBODIMENTS

Figure 1:
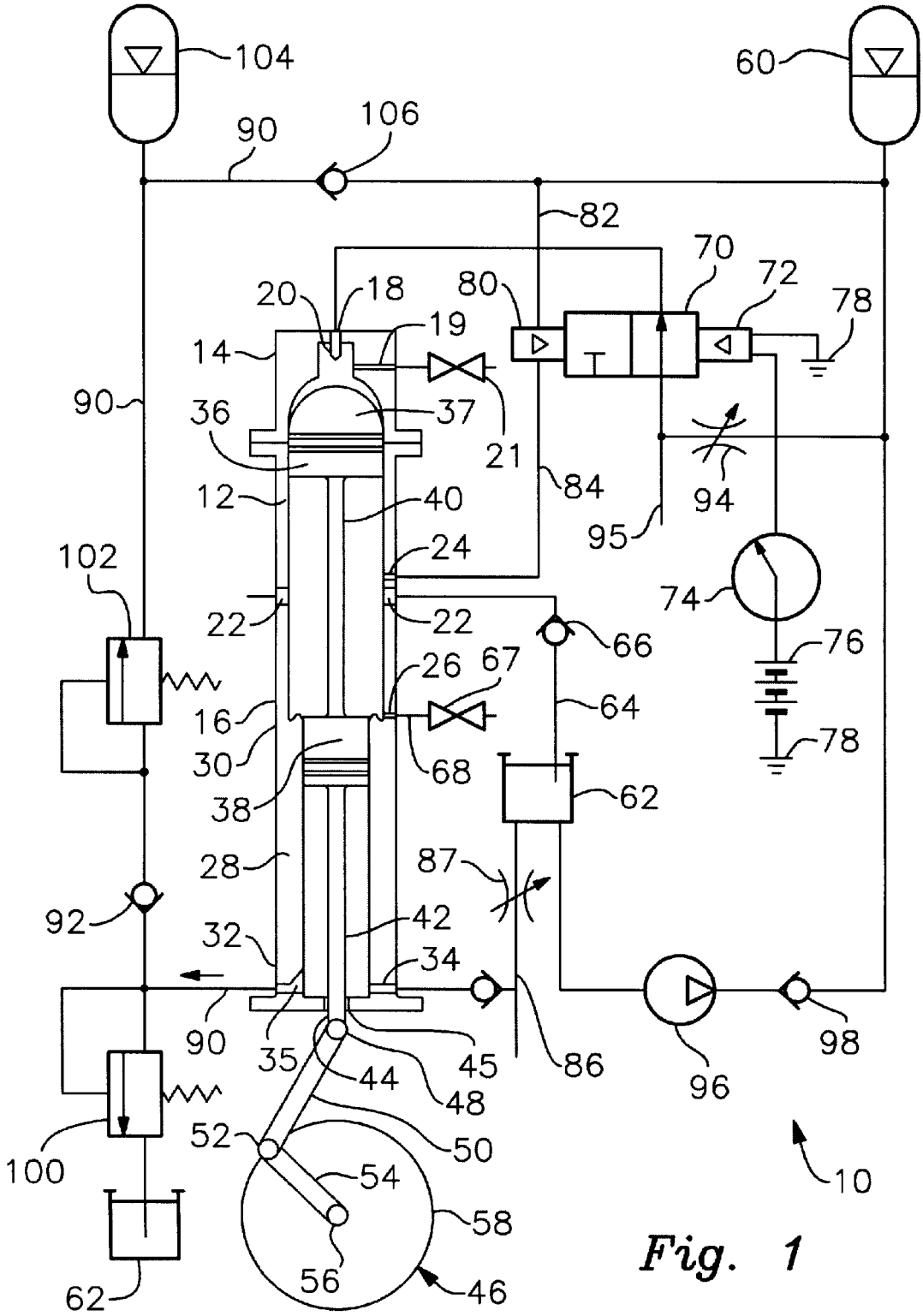
FIG. 1 is a side elevational view of a hydraulic engine constructed in accordance with the invention, showing the cylinders in cross-section with pistons and crank, combined with a schematic of the fluid circuit and components.

Referring now to the drawing, and especially to FIG. 1 thereof, a hydraulic engine is shown at 10, comprising an upper cylinder 12 extending between opposite first 14 and second 16 ends. The first end 14 is closed and includes an intake injector port 18, and an air bleed 19 and air bleed valve 21. The upper cylinder 12 has a predetermined inside diameter. It has an exhaust port 22 intermediate the first 14 and second 16 ends. Preferably, a plurality of exhaust ports encircle the periphery of the upper cylinder in this region to ensure rapid flow of fluid out of the cylinder. An optional sensing port 24 is disposed intermediate the exhaust port 22 and the first end 14, but preferably close to the exhaust port. The upper cylinder has a drain port 26 juxtaposed with the second end 16.

A lower cylinder 28 extends between opposite first 30 and second 32 ends, the first end 30 being connected to the upper cylinder second end 16. The lower cylinder second end 32 is closed and includes an inlet port 34 and an outlet port 35. The lower cylinder 28 has an inside diameter less than the upper cylinder 12 inside diameter.

Figure 2:
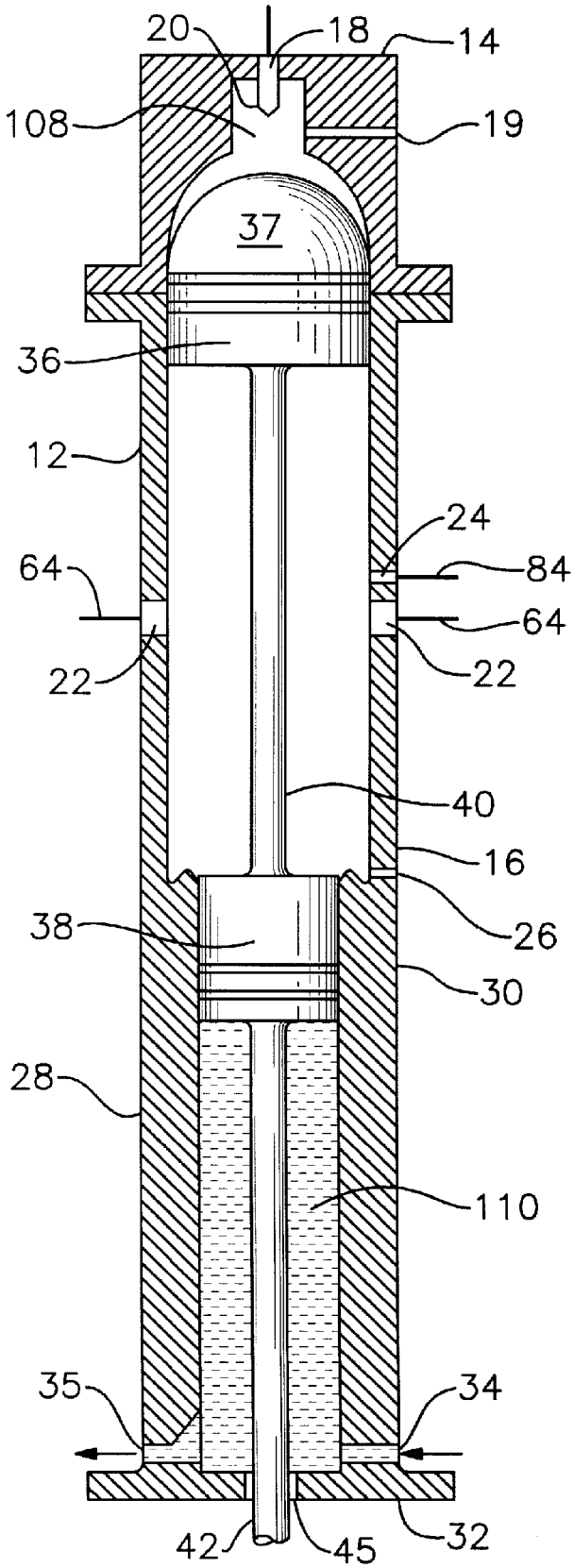
FIG. 2 is a side elevational view of the hydraulic engine of FIG. 1, showing the cylinders in cross-section with the pistons and piston rods, at the beginning of the power stroke.

An upper piston 36 is mounted within the upper cylinder 12 for sealed sliding movement therein. The upper piston 36 has a topmost position adjacent the first end, as shown in FIG. 2. A lower piston 38 is mounted within the lower cylinder 28 for sealed sliding movement therein.

An upper piston rod 40 connects the upper piston 36 with the lower piston 38. A lower piston rod 42 extends from the lower piston 38 toward a distal end 44, and is mounted for sealed sliding movement penetrating the lower cylinder second end 32. A bearing and seal 45 is provided to support the lower piston rod 42.

Converting means 46 is connected to the lower piston rod distal end 44, for converting reciprocating motion to rotary motion. The converting means 46 is conventional, and includes a wrist pin 48 pivotally mounting a connecting rod 50 to the lower piston rod distal end 44. A crankpin 52 pivotally attaches the connecting rod 50 to a crank arm 54 of a crankshaft 56. A flywheel 58 is connected to the crankshaft 56 to store inertial energy to sustain rotation. The angular position of the crankshaft 56 correlates directly with the linear position of the upper piston 36.

A first accumulator 60 is provided for supplying pressurized fluid. A tank 62 is provided for storing fluid at ambient pressure. An exhaust conduit 64 connects the exhaust port 22 with the tank 62. The exhaust conduit 64 has an exhaust check valve 66 for conveying fluid unidirectionally from the exhaust port 22 to the tank 62. A drain and bleed conduit 68 and a drain and bleed valve 67 are connected to the drain port 26.

A control valve 70 has an open position wherein the first accumulator 60 is connected to the intake injector port 18, and a closed position wherein the intake injector port 18 is sealed.

Turning now to FIG. 2, as well as FIG. 1, electrical actuating means, responsive to the position of the upper piston, is provided for actuating the control valve into the open position when the upper piston is in the generally topmost position, as shown in FIG. 2. Specifically, this includes an electromagnetic actuator 72 mounted to the control valve 70, so that when the electromagnetic actuator 72 is energized the control valve 70 is moved into the open position. Also included is an electrical distributor 74 connected to the electromagnetic actuator 72. The distributor 74 is mounted to the crankshaft 56 so as to respond to the position of the upper piston 36 by sensing the correlating angular position of the crankshaft 56. Further included is a source of electricity 76 connected to the distributor 74, and a common ground connection 78, so that when the upper piston 36 is in the generally topmost position, the distributor 74 will close, the electromagnetic actuator 72 will be energized, opening the control valve 70, and causing fluid to flow to the intake injector port 18, as shown in FIG. 2.

Figure 3:
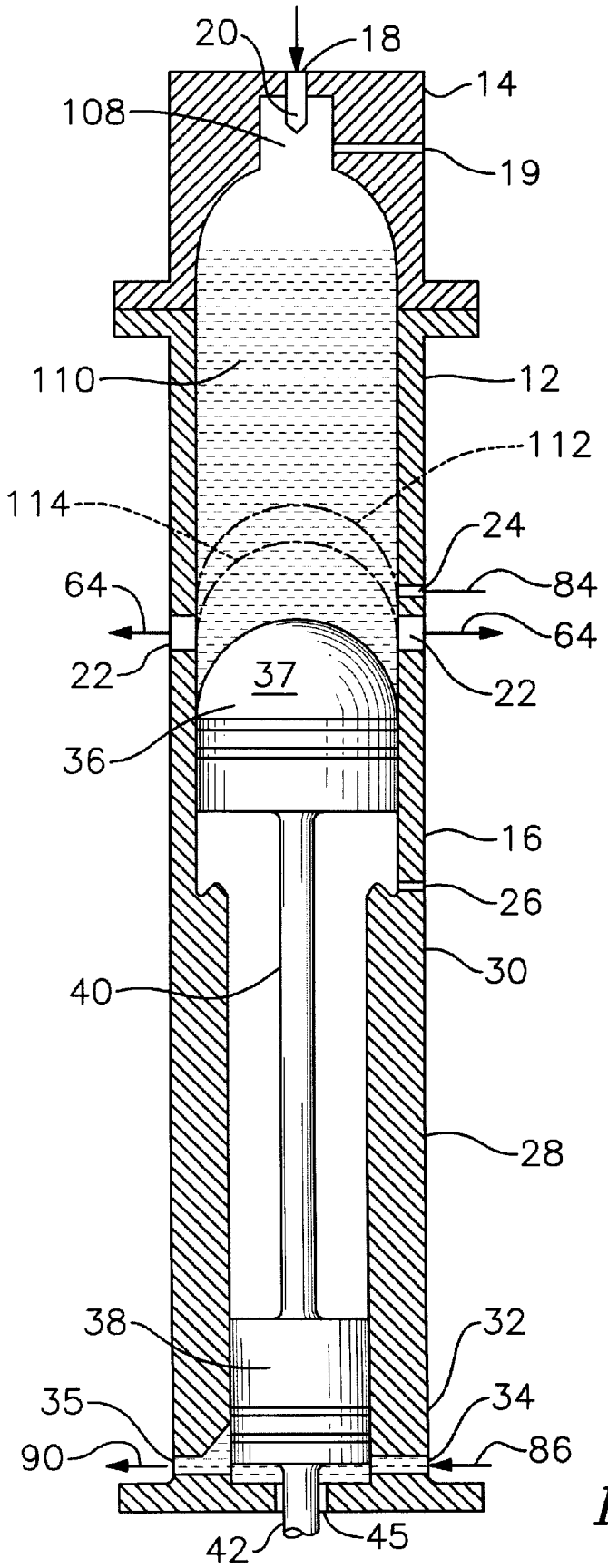
FIG. 3 is a side elevational view of the hydraulic engine of FIG. 1, showing the cylinders in cross-section with the pistons and piston rods, at the end of the power stroke, before the fluid is exhausted from the upper cylinder.

Referring now to FIG. 3, as well as FIGS. 1 and 2, hydraulic actuating means, responsive to the decrease in upper cylinder fluid pressure, is provided for actuating the control valve into the closed position when the upper piston passes the exhaust port, as is shown at 114 in FIG. 3. Specifically, this includes a hydraulic actuator 80 mounted to the control valve 70. The hydraulic actuator 80 is a small cylinder having a dual-acting piston. With pressure to both sides of the piston equal, forces are balanced, and no movement ensues. If a pressure differential develops, the piston will move, actuating the control valve 70 into the closed position.

Although the present invention is designed such that its hydraulic oil flow is controlled valves, the hydraulic actuator 80 may be optionally connected to the optional sensing ports 24. A first sensing conduit 82 is connected which provides a reference pressure from the first accumulator 60, that is, the pressure at the pressurized fluid source, and a second sensing conduit 84 is connected between the hydraulic actuator 80 and the sensing port 24. In this embodiment, when the upper piston 36 passes the exhaust port 22, the upper cylinder fluid pressure will decrease, causing the pressure differential between the upper cylinder 12 and the first accumulator 60, and the first 82 and second 84 sensing conduits will convey the pressure differential to the hydraulic actuator 80, which will respond by closing the control valve 70, shutting off fluid flow to the intake injector port 18. In hydraulic engines where the sensing conduits 82,84 are not utilized, the sensing port 24, if provided, may instead be plugged and utilized as a means to bleed off air pressure in cylinder 12.

An inlet conduit 86 having an inlet check valve 88, is provided for conveying fluid unidirectionally from the tank 62 to the inlet port 34, so that as the lower piston 38 moves upward, fluid will be drawn into the lower cylinder 28, as shown in FIG. 2. An outlet conduit 90 having an outlet check valve 92, is provided for conveying fluid unidirectionally from the outlet port 35 to the first accumulator 60, so that as the lower piston 38 moves downward, fluid will be pressurized, and will flow from the lower cylinder 28 to the first accumulator 60 to generally replenish fluid level and pressure in the first accumulator 60.

First flow regulating means, specifically a first flow regulating valve 94, is connected between the first accumulator 60 and the control valve 70, for regulating the flow rate of fluid into the upper cylinder 12, thereby regulating the speed of the engine. Second flow regulating means, specifically a second flow regulating valve 87 is connected between the tank 62 and the inlet check valve 88 to maintain the flow rate of fluid into the lower cylinder proportionate to the flow rate of fluid into the upper cylinder. A manifold conduit 95 is shown for conveying fluid to other control valves and cylinders in an optional multi-cylinder configuration.

A motor-driven pump 96 optionally is connected between the tank 62 and the first accumulator 60. A pump check valve 98 is connected to the pump 96, so as to pump fluid unidirectionally from the the tank 62 to the first accumulator 60 for initial charging thereof. The pump 96 is then shut off, and the engine runs on pressurized fluid from the first accumulator 60. As is known in the hydraulic and fluid dynamic arts, an accumulator supplies and maintains system pressure by a charge of air against a bladder surrounding the fluid medium, in this case, the hydraulic oil. The means for maintaining a constant charge against the bladder, typically a compressor, is not shown in the drawings as the functionality and operability of an accumulator are well known in the art.

A first pressure actuated valve 100 is connected between the outlet port 35 and the tank 62. This serves as a safety relief valve for the lower cylinder 28. A second pressure actuated valve 102 is connected in the outlet conduit 90 between the outlet port 35 and the first accumulator 60. This valve opens to permit fluid flow to the first accumulator 60.

A second accumulator 104 optionally is connected to the outlet conduit 90 to smooth pressure transients in the outlet flow. An accumulator check valve 106 is connected in the outlet conduit 90 between the first 60 and second 104 accumulators so as to prevent reverse flow from the first accumulator 60 into the outlet conduit 90.

Figure 4:
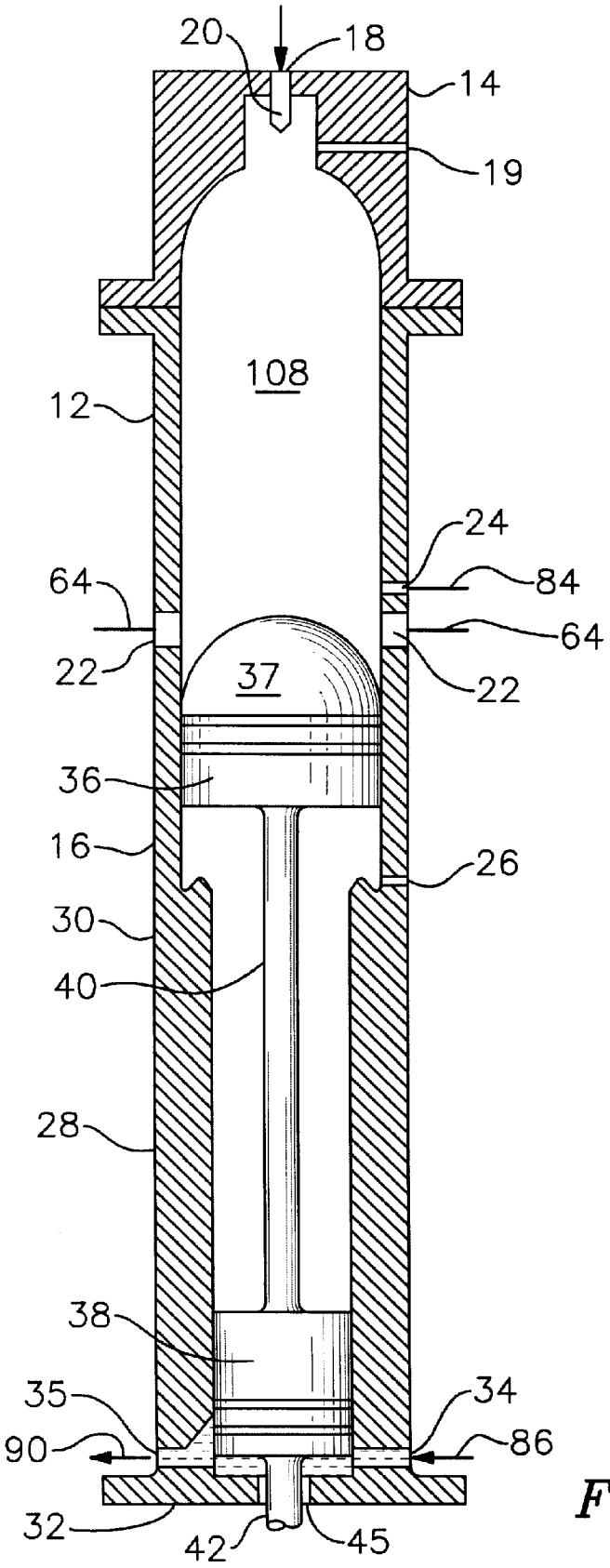
FIG. 4 is a side elevational view of the hydraulic engine of FIG. 1, showing the cylinders in cross-section with the pistons and piston rods, at the end of the power stroke, after the fluid is exhausted from the upper cylinder.

In operation, the cycle begins with the upper piston 36 in the lowermost position as shown in FIG. 4. The upper cylinder 12 has a partial vacuum. The air bleed 19 can be used to adjust the quantity of air and fluid. The dome shape of the piston head 37 helps to ensure that fluid 110 is disposed around the periphery of the upper cylinder 12 to submerge the exhaust ports 22. Sustained by flywheel inertia from the previous cycle, the upper piston 36 moves upward toward the closed first end 14 of the upper cylinder 12, into the topmost position as shown in FIG. 2.

The distributor 74 responds to the position of the upper piston 36 by closing and energizing the electromagnetic actuator 72, which in turn opens the control valve 70, allowing fluid to flow to the intake injector port 18. An optional spray nozzle 20 distributes fluid over the upper piston head 37. Pressurized fluid passes through the intake injector port 18 and enters the upper cylinder 12. The upper piston 36 moves downward in response to the pressurized fluid pressure, as the fluid fills the upper cylinder 12, as shown in FIG. 3.

Up to this point, the pressure at the sensing port 24 was less than the pressurized fluid pressure, as shown in FIG. 2, resulting in a pressure differential that urges the control valve 70 toward the closed position. However, the control valve 70 must remain open as the piston 36 moves downward. Thus, the electromagnetic actuator 72 must remain energized during this period, and must overpower the hydraulic actuator in order to keep the control valve 70 open.

Returning to FIG. 3, the downward moving piston 36 uncovers the sensing port 24 at position 112, raising fluid pressure through the sensing port 24 and the sensing conduit 84 to the hydraulic actuator 80, balancing the pressure, and thereby eliminating actuator forces. At this time the distributor 74 can open, de-energizing the electromagnetic actuator 72. The control valve 70 will remain open. The upper piston 36 continues downward and uncovers the exhaust port 22 at position 114, allowing the fluid pressure to drop. The pressure now drops through the sensing port 24 and the sensing conduit 84 to the hydraulic actuator 80, actuating the control valve 70 into the closed position.

Pressurized fluid ceases to flow through the intake injector port 18. The fluid 110 flows out the exhaust port 22, through the exhaust conduit 64, and into the tank 62, as shown in FIG. 4. The power cycle is now complete, and is repeated as described above.

As the upper piston 36 moves upward, the lower piston 38 moves upward simultaneously, drawing fluid 110 from the tank 62, through the inlet conduit 86 and inlet check valve 88, and into the lower cylinder 28, as shown in FIG. 2. The lower piston 38 then moves downward, toward the position shown in FIG. 3. The fluid 110 is pressurized and flows from the lower cylinder 28, through the outlet conduit 90 and outlet check valve 92, opens and flows through the second pressure actuated valve 102, and to the first accumulator 60 to generally replenish the fluid level and pressure in the first accumulator 60. The recirculating cycle is now complete, and is repeated as described above. In operation, the initially charged first accumulator acts as a pressure source for providing a force to be distributed across the dome-shaped upper piston head 37. Where hydraulic principles teach that pressure will be exerted equally on all exposed surfaces, it can be assumed that the pressure exerted on the dome-shaped piston head 37 will be substantially the same as that exerted at outlet port 35. As previously described, the inner diameter of the upper cylinder 12 is greater than the inner diameter of the lower cylinder 28. This configuration allows a greater force to be generated by the application of the source pressure to the upper cylinder piston than that generated by the lower piston head 38. Piston head 37 thereby acts as a power piston while piston head 38 acts as a pump piston to transmit power to the crankshaft 56. The pump piston action returns the oil volume to the accumulator 60, or energy source, and thereby generates a total workload force combining the loads required to return the fluid and the load required to transmit power to the crankshaft 56. However, the inherent design of the upper and lower cylinders allows for the generation of an excess force by the power piston after satisfaction of the required loads, the excess force therefore being available for combining with the initially charged system pressure at the accumulator 60 such that the accumulator 60 is maintained under a positive pressure sufficient to maintain the operation of the hydraulic engine.

As seen from the foregoing description, the present invention satisfies the need to provide a hydraulic engine capable of producing rotary shaft output, and operating from a source of stored pressurized fluid for long periods of time without any external energy input.

It is to be understood that the above detailed description of embodiments of the invention is provided by way of example only. Various details of design and construction may be modified without departing from the true spirit and scope of the invention as set forth in the appended claims.

The embodiments of the invention in which an exclusive property or privilege is claimed are defined as follows:

1. A hydraulic engine comprising:

an upper cylinder extending between opposite first and second ends, the first end being closed and including an injector port, the upper cylinder having a predetermined inside diameter, and the upper cylinder further having an exhaust port intermediate the first and second ends;

a lower cylinder extending between opposite first and second ends, the first end being connected to the upper cylinder second end, the lower cylinder second end being closed and including an inlet port and an outlet port, the lower cylinder having an inside diameter less than the upper cylinder inside diameter;

an upper piston mounted within the upper cylinder for sealed sliding movement therein, the upper piston being substantially dome-shaped with a topmost position adjacent the first end;

a lower piston mounted within the lower cylinder for sealed sliding movement therein;

an upper piston rod connecting the upper piston with the lower piston;

a lower piston rod projecting from the lower piston and mounted for sealed sliding movement penetrating the lower cylinder second end;

converting means, connected to the lower piston rod, for converting reciprocating motion to rotary motion;

a source of pressurized fluid, the source being an initially charged first accumulator wherein the first accumulator is capable of maintaining the pressurized fluid substantially at an initially charged pressure at the source during operation of the hydraulic engine;

a tank for storing fluid at ambient pressure;

exhaust communicating means for communicating fluid from the exhaust port to the tank;

a control valve having an open position wherein the pressurized fluid source communicates with the injector port, and a closed position wherein the injector port is sealed;

first actuating means, responsive to the position of the upper piston, for actuating the control valve into the open position when the upper piston is in the generally topmost position, so that pressurized fluid will pass through the injector port and enter the upper cylinder, the upper piston will move downward in response to the pressurized fluid pressure, and the upper piston will pass the exhaust port allowing the fluid pressure to decrease to ambient pressure;

inlet communicating means for communicating fluid unidirectionally from the tank to the inlet port, so that as the lower piston moves upward, fluid will be drawn into the lower cylinder;

outlet communicating means for communicating fluid unidirectionally from the outlet port to the pressurized fluid source, so that as the lower piston moves downward, fluid will be pressurized, and will flow from the lower cylinder to the pressurized fluid source to generally replenish the pressurized fluid source;

flow regulating means, connected between the pressurized fluid source and the control valve, for regulating the flow rate of fluid into the upper cylinder, thereby regulating the speed of the engine; and a motor-driven pump connected between the tank and the pressurized fluid source in combination with a unidirectional valve connected to the pressurized fluid source, the pump for initial charging of the pressurized fluid source and for recharging thereof so as to maintain the pressurized fluid source under a pressure sufficient to maintain the operation of the hydraulic engine.

2. The hydraulic engine of claim 1, wherein:

the converting means includes a crankshaft;

the angular position of the crankshaft correlates directly with the linear position of the upper piston; and the first actuating means is connected to the crankshaft, so as to respond to the position of the upper piston by sensing the correlating angular position of the crankshaft.

3. The hydraulic engine of claim 2, further including a sensing port intermediate the exhaust port and the first end of the upper cylinder and second actuating means, responsive to the decrease in upper cylinder fluid pressure from the combined excess pressure and the initially charged pressure at the first accumulator, for actuating the control valve into the closed position when the upper piston passes the exhaust port, so that pressurized fluid will cease to flow through the injector port, and fluid will flow out the exhaust port, through the exhaust communicating means, and into the tank, wherein the second actuating means is connected between the sensing port and the pressurized fluid source.

4. A hydraulic engine comprising:

an upper cylinder extending between opposite first and second ends, the first end being closed and including an injector port, the upper cylinder having a predetermined inside diameter, and the upper cylinder further having an exhaust port intermediate the first and second ends;

a lower cylinder extending between opposite first and second ends, the first end being connected to the upper cylinder second end, the lower cylinder second end being closed and including an inlet port and an outlet port, the lower cylinder having an inside diameter less than the upper cylinder inside diameter;

an upper piston mounted within the upper cylinder for sealed sliding movement therein, the upper piston being substantially dome-shaped with a topmost position adjacent the first end;

a lower piston mounted within the lower cylinder for sealed sliding movement therein;

an upper piston rod connecting the upper piston with the lower piston;

a lower piston rod extending from the lower piston toward a distal end, and mounted for sealed sliding movement penetrating the lower cylinder second end;

converting means, connected to the lower piston rod distal end, for converting reciprocating motion to rotary motion;

a first accumulator for supplying pressurized fluid, the first accumulator being initially charged and capable of maintaining the pressurized fluid substantially at an initial charged pressure during operation of the hydraulic engine;

a tank for storing fluid at ambient pressure;

an exhaust conduit connecting the exhaust port with the tank, having a check valve for conveying fluid unidirectionally from the exhaust port to the tank;

a control valve having an open position wherein the first accumulator is connected to the injector port, and a closed position wherein the injector port is sealed;

electrical actuating means, responsive to the position of the upper piston, for actuating the control valve into the open position when the upper piston is in the generally topmost position, so that pressurized fluid will pass through the injector port and enter the upper cylinder, the upper piston will move downward in response to the pressurized fluid pressure, and the upper piston will pass the exhaust port allowing the fluid pressure to decrease to ambient pressure;

an inlet conduit having an inlet check valve, for conveying fluid unidirectionally from the tank to the inlet port, so that as the lower piston moves upward, fluid will be drawn into the lower cylinder;

an outlet conduit having an outlet check valve, for conveying fluid unidirectionally from the outlet port to the first accumulator, so that as the lower piston moves downward, fluid will be pressurized, and will flow from the lower cylinder to the first accumulator to generally replenish fluid level and pressure in the first accumulator;

first flow regulating means, connected between the first accumulator and the control valve, for regulating the flow rate of fluid into the upper cylinder, thereby regulating the speed of the engine; and a motor-driven pump connected between the tank and the pressurized fluid source in combination with unidirectional valve connected to the pressurized fluid source, the pump for initial charging of the pressurized fluid source and for recharging thereof so as to maintain the pressurized fluid source under a pressure sufficient to maintain the operation of the hydraulic engine.

5. The hydraulic engine of claim 4, wherein:

the converting means includes a crankshaft; and the angular position of the crankshaft correlates directly with the linear position of the upper piston.

6. The hydraulic engine of claim 5, wherein the electrical actuating means further comprises:

an electromagnetic actuator mounted on the control valve, so that when the electromagnetic actuator is energized the control valve is moved into the open position;

an electrical distributor connected to the electromagnetic actuator, the distributor being attached to the crankshaft for simultaneous rotation therewith so as to respond to the position of the upper piston by sensing the correlating angular position of the crankshaft; and a source of electricity connected to the distributor, so that when the upper piston is in the generally topmost position, the electromagnetic actuator will be energized, opening the control valve, and causing fluid to flow to the injector port.

7. The hydraulic engine of claim 6, wherein the hydraulic actuating means further comprises:

a sensing port intermediate the exhaust port and the first end of the upper cylinder and the hydraulic actuating means;

a hydraulic actuator mounted to the control valve, the hydraulic actuator being responsive to a decrease in upper cylinder fluid pressure from the combined excess pressure and the initially charged pressure at the first accumulator to move the control valve into the closed position;

a first sensing conduit connected between the first accumulator and the hydraulic actuator, so as to provide a reference pressure, being the combined excess pressure and the initially charged pressure at the first accumulator, to the hydraulic actuator; and a second sensing conduit connected between the sensing port and the hydraulic actuator, so that when the upper piston passes the exhaust port, the upper cylinder fluid pressure will decrease, causing a pressure differential between the upper cylinder internal pressure and the reference pressure, and the first and second sensing conduits will convey the pressure differential to the hydraulic actuator, which will respond by closing the control valve, shutting off fluid flow to the injector port.

8. The hydraulic engine of claim 4, further comprising a first pressure actuated valve connected between the outlet port and the tank, the first pressure actuated valve being a pressure relief valve wherein released fluid is directed to the tank.

9. The hydraulic engine of claim 8, further comprising a second pressure actuated valve connected in the outlet conduit between the outlet port and the first accumulator.

10. The hydraulic engine of claim 9, further comprising:

a second accumulator connected to the outlet conduit; and an accumulator check valve connected in the outlet conduit between the first and second accumulators so as to prevent reverse flow from the first accumulator into the outlet conduit.

11. The hydraulic engine of claim 10, further comprising second flow regulating means, connected between the tank and the inlet check valve to maintain the flow rate of fluid into the lower cylinder proportionate to the flow rate of fluid into the upper cylinder.

12. A method of converting hydraulic energy to perform useful work, the method comprising the steps of;

mounting an upper piston for sealed sliding movement within an upper cylinder having a predetermined inside diameter, the upper piston being substantially dome-shaped;

connecting a control valve between a pressurized fluid source and the upper cylinder;

moving the upper piston upward toward a closed end of the upper cylinder;

actuating the control valve into an open position when the upper piston is in a generally topmost position, thereby introducing pressurized fluid from the pressurized fluid source through an injector port into the upper cylinder;

moving the upper piston downward, away from the closed end, in response to the pressurized fluid pressure;

moving the upper piston past an exhaust port in the upper cylinder thereby uncovering the exhaust port;

allowing fluid to pass through the exhaust port into an ambient pressure region, thereby decreasing the fluid pressure internal to the upper chamber and causing a pressure differential between an internal pressure in the upper cylinder and a pressure at the pressurized fluid source, the pressurized fluid source being an initially charged first accumulator;

actuating the control valve into a closed position in response to the decrease in upper cylinder fluid pressure, thereby shutting off the flow of pressurized fluid;

allowing the fluid to flow out the exhaust port into a fluid storage tank at ambient pressure;

connecting a lower cylinder collinearly to the upper cylinder, the lower cylinder having a closed end opposite the upper cylinder closed end, the lower cylinder having an inside diameter less than the upper cylinder inside diameter;

mounting a lower piston for sealed sliding movement within the lower cylinder;

connecting the upper piston to the lower piston with an upper piston rod;

extending a lower piston rod from the lower piston toward a distal end, and mounting the rod for sealed sliding movement penetrating the lower cylinder closed end;

moving the lower piston upward, away from the closed end, thereby drawing fluid from the tank through a check valve into the lower cylinder closed end;

moving the lower piston downward toward the closed end, thereby pressurizing the fluid, and causing the fluid to flow from the lower cylinder through a check valve to the pressurized fluid source, generally replenishing the pressurized fluid source;

converting reciprocating motion to rotary motion;

regulating the flow rate of fluid into the upper cylinder, thereby regulating the speed of the engine;

regulating the flow rate of fluid into the lower cylinder in proportion to the flow rate of fluid into the upper cylinder; and connecting a motor-driven pump between the tank and the pressurized fluid source in combination with a unidirectional valve connected to the pressurized fluid source, the pump for initial charging of the pressurized fluid source and for recharging thereof so as to maintain the pressurized fluid source under a pressure sufficient to maintain the operation of the hydraulic engine.

13. The method of claim 12, wherein the step of converting reciprocating motion to rotary motion further comprises the steps of:

converting reciprocating motion, at the lower piston rod distal end, to rotary motion; and correlating the angular position of the rotary motion directly with the linear position of the upper piston.

14. The method of claim 13, wherein the step of actuating the control valve into an open position further comprises the steps of:

mounting an electromagnetic actuator on the control valve;

operating an electrical distributor in direct correlation to the rotary motion;

connecting a source of electricity to the electromagnetic actuator and to the distributor; and energizing the electromagnetic actuator in response to the position of the upper piston, thereby actuating the control valve into the open position, when the upper piston is in the generally topmost position.

15. The method of claim 14, wherein the step of actuating the control valve into a closed position further comprises the steps of:

mounting a hydraulic actuator on the control valve, the hydraulic actuator being responsive to a decrease in upper cylinder pressure, from the combined excess pressure and the initially charged pressure at the first accumulator to move the control valve into the closed position;

connecting a first sensing conduit between the hydraulic actuator and the pressurized fluid source, so as to provide a reference pressure to the hydraulic actuator, the reference pressure being the combined excess pressure and initially charged pressure at the first accumulator;

providing a sensing port intermediate the exhaust port and the first end of the upper cylinder;

connecting a second sensing conduit between the hydraulic actuator and the sensing port in the upper cylinder, so that when the upper piston passes the exhaust port, the upper cylinder fluid pressure will decrease, causing a pressure differential between the upper cylinder internal pressure and the first accumulator pressure, and the first and second sensing conduits will convey the pressure differential to the hydraulic actuator, which will respond by closing the control valve, shutting off fluid flow to the injector port.

16. A hydraulic cylinder and piston combination comprising:

an upper cylinder extending between opposite first and second ends, the first end being closed and including an injector port, the upper cylinder having a predetermined inside diameter, and the upper cylinder further having an exhaust port intermediate the first and second ends;

a lower cylinder extending between opposite first and second ends, the first end being connected to the upper cylinder second end, the lower cylinder second end being closed and including an inlet port and an outlet port, the lower cylinder having an inside diameter less than the upper cylinder inside diameter;

an upper piston mounted within the upper cylinder for sealed sliding movement therein, the upper piston being substantially dome-shaped with a topmost position adjacent the first end;

a lower piston mounted within the lower cylinder for sealed sliding movement therein;

an upper piston rod connecting the upper piston with the lower piston;

a lower piston rod projecting from the lower piston and mounted for sealed sliding movement penetrating the lower cylinder second end;

converting means, connected to the lower piston rod, for converting reciprocating motion to rotary motion;

the injector port for directing a source of pressurized fluid to the dome-shaped upper piston, wherein when the pressurized fluid passes through the injector port and enters the upper cylinder, the upper piston will move downward in response to the pressurized fluid pressure, and the upper piston will pass the exhaust port allowing the fluid pressure to return the fluid to a source of stored fluid at ambient pressure;

the inlet port for drawing fluid from the source of stored fluid at ambient pressure into the lower cylinder when the lower piston moves upward; and the outlet port for replenishing the pressurized fluid source when the lower piston moves downward and pressurized the fluid in the lower cylinder, wherein the source of pressurized fluid is adapted to maintain an operating pressure sufficient to maintain the operation of the hydraulic cylinder and piston combination.

17. The hydraulic cylinder and piston combination of claim 16, further including a sensing port intermediate the exhaust port and the first end of the upper cylinder, the sensing port for communicating with a control valve.

* * * * *